US006543166B1

(12) United States Patent
Griffin

(10) Patent No.: US 6,543,166 B1
(45) Date of Patent: Apr. 8, 2003

(54) SIGN DECORATION SYSTEM WITH FLEXIBLE HOLDER

(75) Inventor: Alan G. Griffin, Green Bay, WI (US)

(73) Assignee: Griffin Group, Inc., Green Bay, WI (US)

( * ) Notice: Subject to any disclaimer, the term of this patent is extended or adjusted under 35 U.S.C. 154(b) by 0 days.

(21) Appl. No.: 10/060,671

(22) Filed: Feb. 1, 2002

(51) Int. Cl.[7] ..... G09F 7/02
(52) U.S. Cl. ..... 40/618; 40/620
(58) Field of Search ..... 40/618, 620, 622, 40/576

(56) References Cited

U.S. PATENT DOCUMENTS

| | | | | |
|---|---|---|---|---|
| 2,084,238 A | | 6/1937 | Best | |
| 3,840,261 A | | 10/1974 | Fulkerson et al. | |
| 4,265,040 A | | 5/1981 | Sarkisian | |
| 4,334,372 A | * | 6/1982 | Colmar | 40/650 |
| 4,446,640 A | * | 5/1984 | Kenney | 40/618 |
| 4,620,736 A | | 11/1986 | Shanks | |
| 5,357,701 A | * | 10/1994 | Grate | 40/618 |
| 5,419,066 A | * | 5/1995 | Harnois et al. | 40/661.03 |
| 6,216,375 B1 | | 4/2001 | Griffin | |

* cited by examiner

*Primary Examiner*—Gary Hoge
(74) *Attorney, Agent, or Firm*—Donald Cayen

(57) ABSTRACT

A holder is made from flexible material and is held in tracks of a conventional reader board. The holder has upper and lower edges that lie in a common plane and are normally separated by a first distance. A middle region lies forward of the common plane. The middle region includes channels having downwardly converging surfaces for removably receiving a decoration with similarly converging sides in wedging engagement. At removal, a person uses a suction cup to grip the decoration. Force applied to the suction cup pushes the decoration and the holder middle region toward the reader board, causing the holder middle region to flex and increase the distance between the upper and lower edges of the holder, hence moving the edges farther into the reader board tracks. The holder lower edge is then unable to slide upwardly and come out of the reader board and fall on the person.

21 Claims, 7 Drawing Sheets

SIGN DECORATION SYSTEM WITH FLEXIBLE HOLDER

FIELD OF THE INVENTION

This invention pertains to advertising, and more particularly to apparatus that enhances the appearance of displays on reader boards.

BACKGROUND OF THE INVENTION

Various types of equipment have been developed to display commercial advertising and other promotional messages. For example, reader boards that hold interchangeable characters such as numerals and alphabet letters are well known and in widespread use. Examples of these reader boards may be seen in U.S. Pat. Nos. 4,237,637; 4,265,040; 5,257,472; 5,357,701; and 5,367,800. U.S. Pat. No. 6,216,375 to Griffin discloses and claims a sign decoration system comprising a holder and a decoration that is removably received by the holder.

In some instances, the reader boards are translucent or transparent such that a source of illumination can backlight the characters on the board. U.S. Pat. Nos. 4,367,604 and 5,588,238 show backlit menu boards.

U.S. Pat. No. 5,542,202 and Des. U.S. Pat. No. 354,313 show representative plates that include characters for display. The plate of the U.S. Pat. No. 5,542,202 patent is especially useful with backlit reader boards.

Despite the large variety of reader boards, alphanumeric characters, and character plates that are presently available, they are limited in the size and variety of graphic arts that can be handled. U.S. Pat. No. 4,367,604 shows graphic picture units, but they must be custom made to suit a particular reader board. U.S. Pat. No. 5,588,238 shows pictorial assemblies that are sandwiched between transparent window panels. The pictorial assemblies must thus be of a specific size and shape. In addition, the design of the U.S. Pat. No. 5,588,238 patent is such that it is difficult to change or rearrange the pictorial assembly after it has been created.

A further disadvantage of existing display equipment is that the numeral and alphabet letter plates are limited to use between adjacent tracks of a reader board. The plates are all of the same height so as to fit within the tracks. Accordingly, variations in character heights in a particular reader board are usually not possible.

A still further disadvantage of some existing display equipment is that the equipment may become unstable during use. For example, some character plates and decorations may fall from the tracks of a reader board when being inserted or removed. Accordingly, use of such display equipment can pose a serious hazard to people in the vicinity during insertion and removal of a decoration or character plate.

Thus, a need exists for improvements in the way graphic and alpha-numeric materials are held on reader boards.

SUMMARY OF THE INVENTION

In accordance with the present invention, an eye-catching sign decoration system is provided that has improved retention within conventional reader boards. This is accomplished by apparatus that includes a flexible holder held in adjacent reader board tracks and decorations removably secured to the holder.

The holder is made from a sheet of flexible material, such as plastic or metal. The holder has an upper edge and a lower edge that are in a common plane and are separated by a predetermined first distance. The first distance is less than the distance between two reader board tracks. A middle region lies between the upper and lower edges and forward of the common plane. According to one aspect of the invention, the holder middle region has a substantially flat middle panel with short legs that connect to forwardly converging upper and lower panels that are adjacent the upper and lower edges, respectively. In another embodiment, the upper and lower panels are coplanar. According to a further embodiment, the holder middle region comprises a curved surface. In a still further embodiment, the middle region comprises a continuously curved surface between two generally coplanar panels that are adjacent the upper and lower edges. In all embodiments of the holder, the holder middle region has channels with downwardly converging surfaces for removably receiving a selected decoration.

The holder is removably held within two tracks of a conventional reader board. To do so, the holder upper edge is slid upwardly into the upper track, the lower edge is swung until it is against the reader board back panel, and the holder is slid downwardly so that its lower edge rests on the lower track. The upper and lower edges are spreadable apart to a distance greater that the first distance in response to pushing the middle region toward the reader board back panel.

The decoration is preferably made from a thin sheet of material such as wood, metal, plastic, or heavy paper. The decoration has side edges that converge at the same angle as the converging surfaces in the channels of the holder. The decoration may be of any desired size and shape as long as the side edges fit in the holder channels. In that manner, different decorations can be interchangeably used with the holder of the present invention. Any desired graphic can be imprinted or otherwise applied to the decoration front face.

Normally, the reader board is high above the ground. A person uses a suction cup attached to a long pole to pick up a decoration that is initially laid on the ground. To insert the decoration, the person lifts the pole and positions the decoration above the holder channels and lowers the decoration into the holder channels. The decoration thus wedges into the channels.

At removal, the person again uses the pole and suction cup. To grip the decoration with the suction cup, the person must push the suction cup against the decoration. Doing so transfers the force of the suction cup to the holder and pushes the holder middle section toward the reader board. This increases the distance between the upper and lower edges of the holder. The upper and lower edges hence move farther into the tracks. An upward force on the decoration by the suction cup to remove the decoration from the holder channels does then not enable the holder to slide upwardly in a manner that would enable the holder lower edge to come out of the reader board lower track and fall on the person. Thus, a major advantage of the present invention is that the holder remains held within the tracks during insertion and removal of a decoration.

Other advantages, benefits, and features of the invention will become apparent to those skilled in the art upon reading the detailed description of the invention and studying the drawings.

DETAILED DESCRIPTION OF THE INVENTION

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

Figure 2:
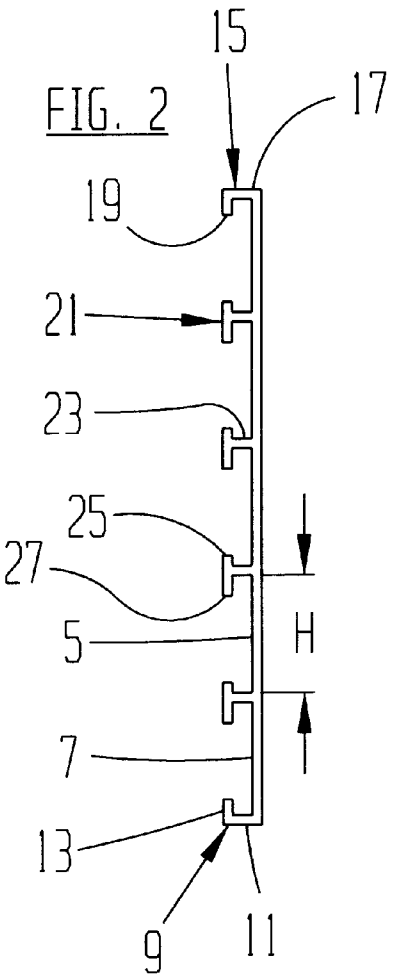
FIG. 2 is an end view of the reader board shown in FIG. 1.
Figure 1:
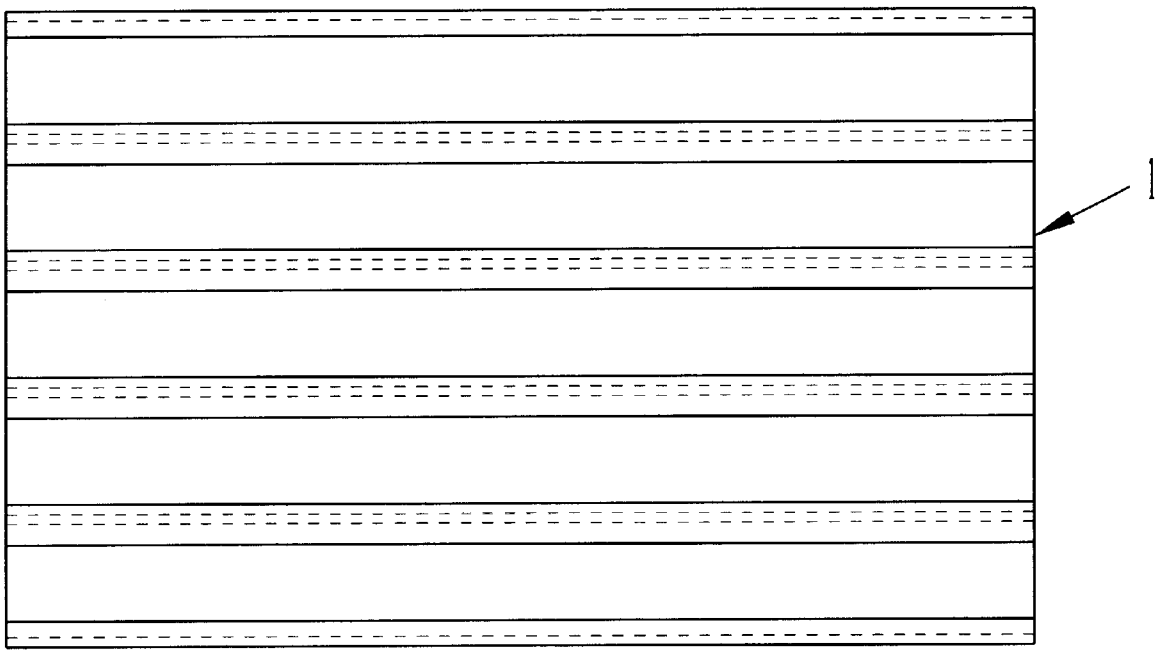
FIG. 1 is a front view of a conventional reader board that is advantageously used with the present invention.

Referring to FIG. 1, a conventional reader board 1 is illustrated. The reader board 1 itself is merely representative of a wide variety of reader boards for indoor and outdoor use. The reader board 1 may be translucent or transparent for lighting purposes, or it may be opaque. The reader board 1 includes a back wall 5 that is substantially vertical. The wall 5 has a front surface 7. The reader board 1 has a bottom track 9 and a top track 15. As shown in FIG. 2, the L-shaped bottom track 9 comprises a ledge 11 and a lip 13 upstanding from the ledge. The inverted L-shaped top track 15 comprises a ledge 17 having a depending lip 19. One or more intermediate T-shaped tracks 21 are between the bottom and top tracks 9 and 15, respectively. Each intermediate track 21 has a ledge 23 that projects from the back wall front surface 7. Each intermediate track 21 has an upstanding lip 25 and a depending lip 27. The distance between the ledges of two adjacent tracks is the track height H.

Figure 4:
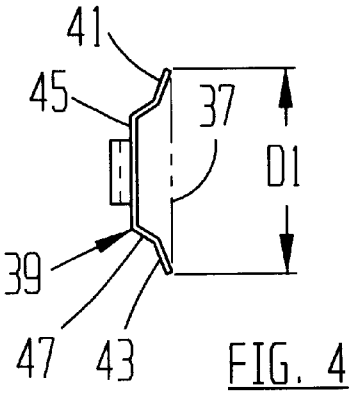
FIG. 4 is an end view of the holder of FIG. 3.
Figure 5:
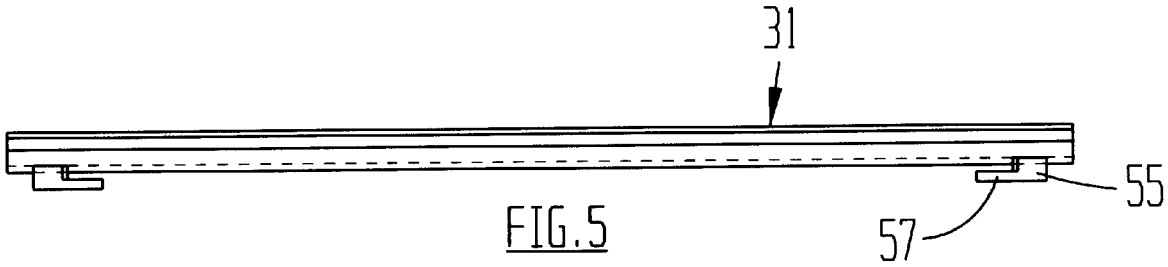
FIG. 5 is a top view of the holder of FIG. 3.
Figure 3:
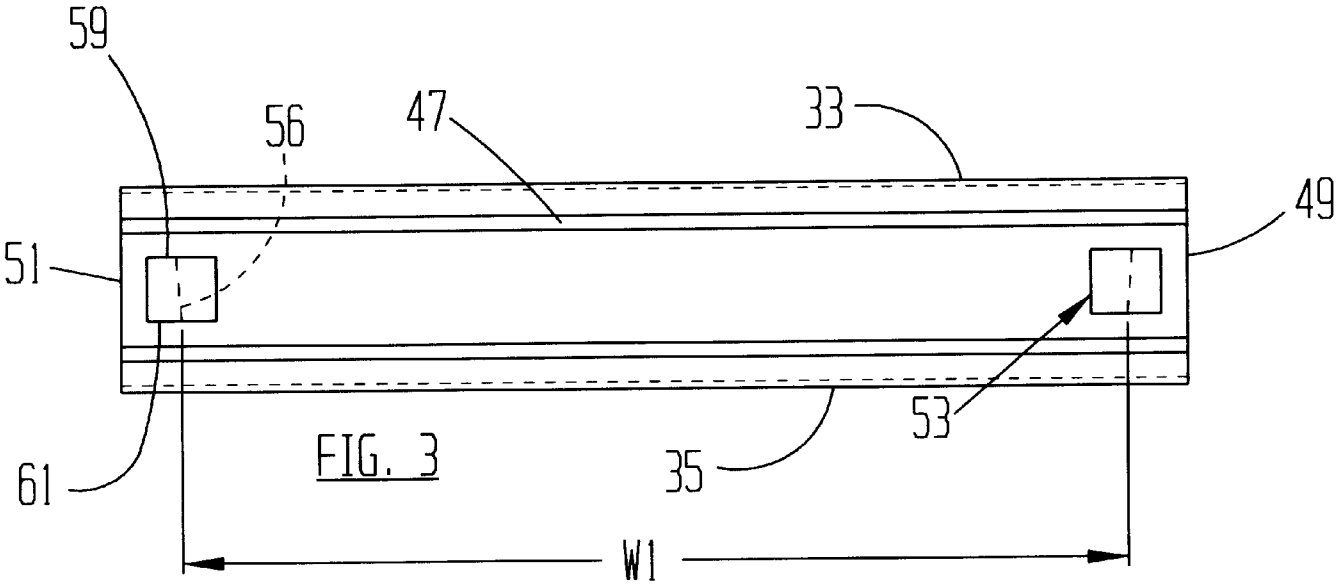
FIG. 3 is a front view of the holder of the present invention.

The holder 31 of the present invention is best shown in FIGS. 3–5. The holder 31 is preferably made of a flexible material such as plastic. It will be understood by those skilled in the art that other flexible materials such as metal may be used without departing from the broad aspects of the invention. The holder 31 may be transparent, translucent, or opaque without departing from the broad aspects of the invention.

The holder 31 has an upper edge 33, an opposed lower edge 35, and opposed ends 49 and 51. The top edge 33 is preferably parallel to the bottom edge 35. Edges 33 and 35 lie in a common plane 37. The edges 33 and 35 are separated by a first distance D1. The first distance D1 is less than the track height H.

The holder 31 has a middle region 39 between the edges 33 and 35. The middle region 39 has a flat upper panel 41 and an opposed and like-shaped flat lower panel 43. The upper and lower panels forwardly converge at an interior angle of approximately 160 degrees. Upper and lower panels 41 and 43 contain the upper and lower edges 33 and 35. A middle panel 45 is joined to the upper and lower panels 41 and 43 by two short legs 47 such that the middle panel 45 is forward of plane 37. The middle panel 45 is generally flat, and lies in a plane parallel to plane 37. Each leg 47 is outwardly angled approximately ten degrees from perpendicular away from the middle panel 45.

A generally L-shaped channel 53 is formed on the middle panel 45 at or near each of the holder ends 49 and 51. Each channel 53 includes an abutting-wall 55 that is substantially perpendicular to the middle panel 45. Each channel 53 also has a retaining wall 57 that is substantially perpendicular to the abutting wall 55 and parallel to the middle panel 45. The abutting walls 55 have corresponding facing surfaces 56 that are each tapered a predetermined amount, converging at a preferred combined angle of about ten degrees toward the lower edge 35. The facing surfaces 56 are separated by a nominal width W1. Each channel 53 has a top 59 and a bottom 61.

Figure 7:
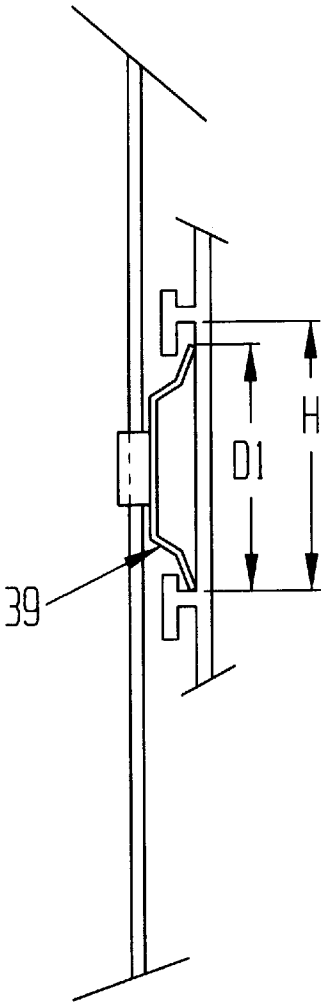
FIG. 7 is an end view of FIG. 6 during normal use.

The holder 31 is inserted into the reader board 1 in one of two ways. The first way is to slide the holder 31 into the ends of two adjacent tracks. A second way is to first insert the upper edge .33 of the holder 31 behind the depending lip of a desired track, such as lip 19 of track 15, and causing the edge 33 to abut the associated ledge 17. The lower edge 35 of the holder 31 is then swung in the rearward direction until it is located above the corresponding ledge 23 of the next lower track 21. The holder is lowered behind the corresponding upstanding lip 27 until the holder lower edge 35 rests on the lower ledge. As shown in FIG. 7, distance DI between the holder edges 33 and 35 is less than the height H between two adjacent ledges.

Figure 6:
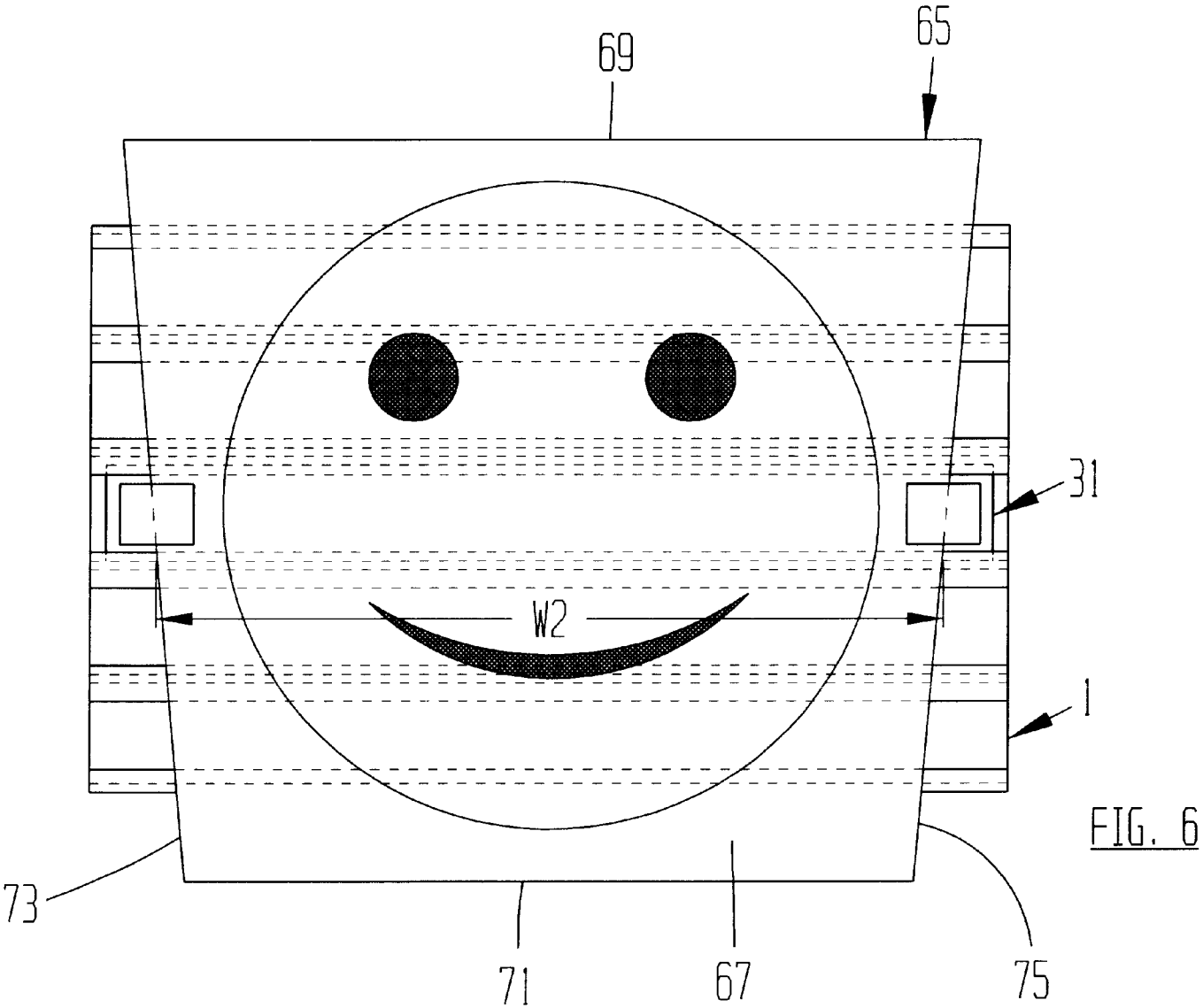
FIG. 6 is a front view of the decoration shown held in the holder of the present invention, which is held between adjacent tracks of a conventional reader board.

A decoration 65 for use with the present invention is shown in FIGS. 6 and 7. The decoration 65 has a front surface 67 that is preferably flat. Front surface 67 is bounded by a top edge 69, a bottom edge 71, a first side edge 73 and a second side edge 75. The top and bottom edges 69 and 71 may have any shape, and they define the decoration height. The decoration height can vary a great amount without departing from the broad aspects of the invention. Opposed first and second side edges 73 and 75, respectively, downwardly converge a predetermined amount. This convergence is the same as the angle in which the surfaces 56 of the holder channels 53 converge. The edges 73 and 75 are separated by a nominal width W2. At some point along the decoration's height, its nominal width W2 is equal to the nominal width W1 between the converging surfaces 56 of the holder channels.

In many applications, the reader board 1 is at a considerable height above the ground. A decoration 65 is inserted into and removed from the holder 31 by a suction cup on a long pole, not shown. In those situations, the decoration is normally initially laid flat on the ground. The suction cup is used to grip the decoration front surface 67. Raising the pole lifts the suction cup and decoration to the height of the reader board. The person can thus manipulate the decoration while remaining on the ground.

With the decoration 65 gripped by a suction cup, the decoration is received by the holder 31 by placing the decoration above the channels surfaces 56. The decoration is then lowered by means of the pole and suction cup such that the decoration first and second side edges 73 and 75, respectively, are wedged between the surfaces 56.

Removal of the decoration 65 occurs in an opposite manner. The pole is maneuvered to press the suction cup against the decoration front surface 67. The decoration is raised from wedging engagement with the channel surfaces 56, and pulled forward from the holder 31.

Figure 8:
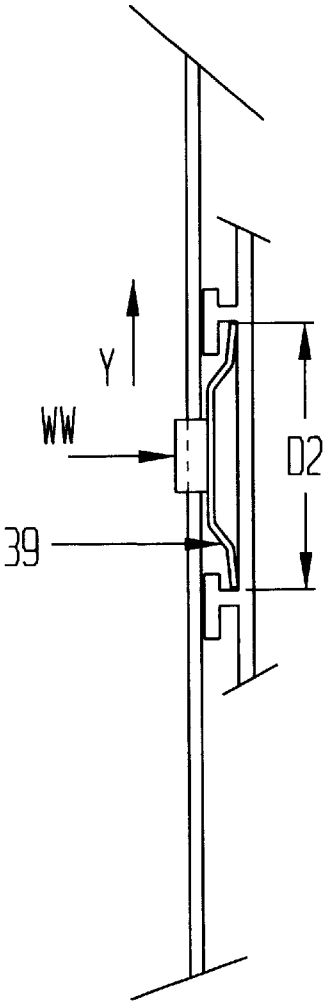
FIG. 8 is an end view similar to FIG. 7, but showing the deflection of the holder during removal of the decoration from the holder.

In accordance with one advantage of this invention, the holder 31 remains held in the reader board 1 during insertion and especially during removal of a decoration 65, as shown in FIG. 8. In the normal course of removal, the suction cup must be first pressed in the direction of arrow WW against the decoration, and then pushed upwardly in the direction Y to remove the decoration from the channels 53. The design of the holder prevents it from sliding up in the tracks and coming out of the tracks, and then falling to the ground during removal of a decoration. This is achieved by the transfer of the force applied by the suction cup to the middle region 39 of the holder. The holder middle region flexes towards the plane 37 containing the upper and lower edges 33 and 35, respectively, which are prevented from moving in the direction of the force WW by the reader board back wall 5. The holder legs 47 bend about their junctions with the middle panel 45 and with the upper and lower panels 41 and 43, respectively. The legs 47 become oriented more closely to parallel with the plane 37. This reorientation of the legs 47 increases the distance between the holder upper and lower edges. Further, the upper and lower panels become oriented more closely to parallel with plane 37. This change in orientation contributes to the upper edge and lower edges spreading apart to a second distance D2, causing the edges to move further into the tracks. When spread apart to the second distance D2, the upper and lower edges are incapable of being removed from behind the lips of the tracks.

Figure 9:
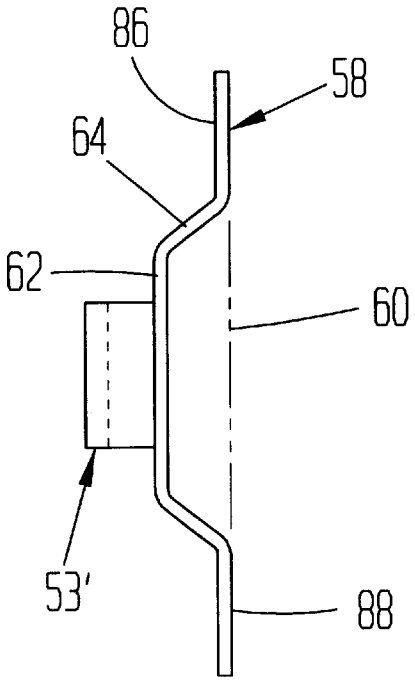
FIG. 9 is an end view of a modified embodiment of the holder.

Another embodiment of the present invention is shown in FIG. 9. In this embodiment, holder 58 has upper and lower panels 86 and 88 that are coplanar and lie in a plane 60 parallel to a middle panel 62. The holder 58 has channels 53' that may be substantially identical to the channels 53 of the holder 31 described above. This design is satisfactory in some instances where the holder material is especially thin and/or flexible. Sufficient deflection to prevent inadvertent removal of the holder 58 from a reader board can be achieved from the legs 64 without having to angle the panels 66 and 68 relative to the plane 60.

Figure 11:
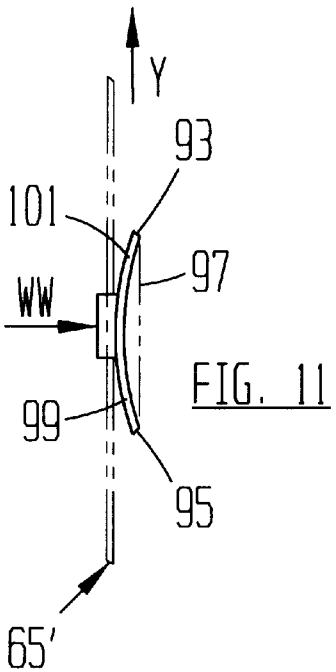
FIG. 11 is an end view of the holder of FIG. 10.
Figure 12:
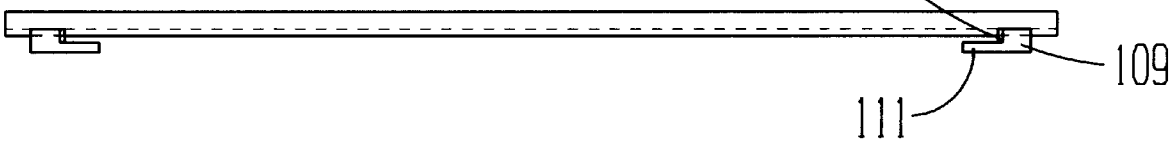
FIG. 12 is a top view of the holder of FIG. 10.
Figure 10:
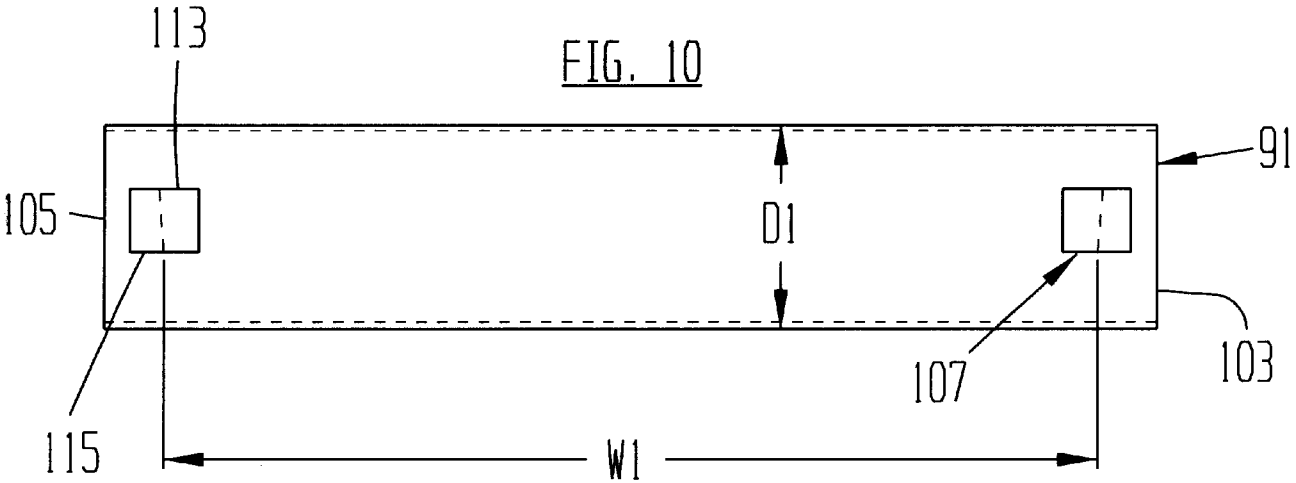
FIG. 10 is a front view of a further embodiment of the holder.

Another embodiment of the present invention is shown in FIGS. 10–12. In this embodiment, the holder 91 has a middle region 99 between an upper edge 93, a lower edge 95, and opposed ends 103 and 105. The upper and lower edges 93 and 95, respectively, are separated by a predetermined distance D1. The upper edge 93 is preferably parallel to the lower edge 95. The upper and lower edges 93 and 95 lie in a common plane 97. The middle region 99 is comprised of a substantially continuously curved surface 101 between the upper and lower edges.

A channel 107 is formed at or near each of the opposed ends 103 and 105 of the holder 91. Each channel 107 includes an it abutting wall 109 projecting perpendicular to the curved surface 101. Each channel 107 also has a retaining wall 111 that is perpendicular to the abutting wall 109. Surfaces 110 of the abutting walls 109 downwardly converge at a predetermined amount, preferably converging at a combined angle of 10 degrees. The surfaces 110 are separated by a nominal width W1. The channels 107 have respective tops 113 and bottoms 115.

A decoration 65' is received by the holder 91 in the same manner described for the previously described embodiments. The holder 91 remains held in a reader board during insertion and especially during removal of the decoration 65'. During removal, a suction cup is first pressed against the decoration 65' in the direction WW, and then pushed upwardly in the direction Y. The force applied by the suction cup to the decoration 65' is transferred to the holder 91. The curved middle region 99 flattens out in response to this force. The upper and lower edges 93 and 95, respectively, spread apart and extend farther into the reader board upper and lower tracks. The holder upper and lower edges are then incapable of being removed from behind the tracks lips.

Figure 15:
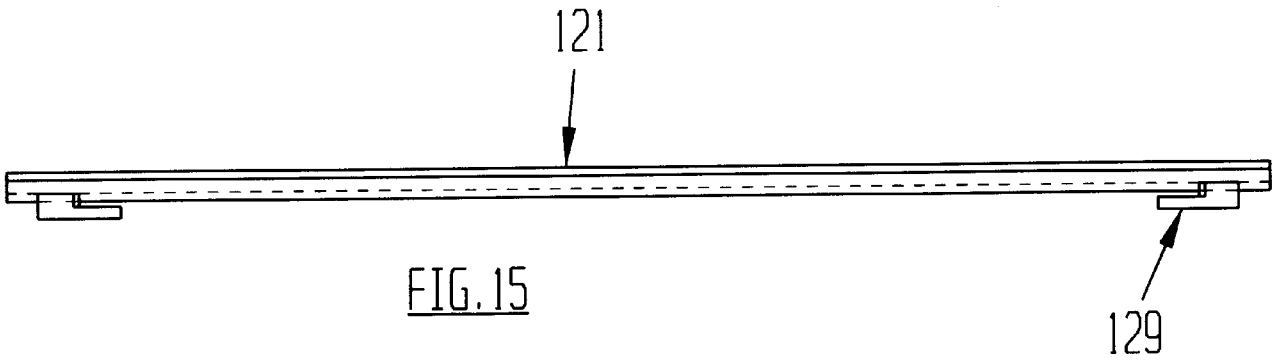
FIG. 15 is a top view of the holder of FIG. 13.
Figure 13:
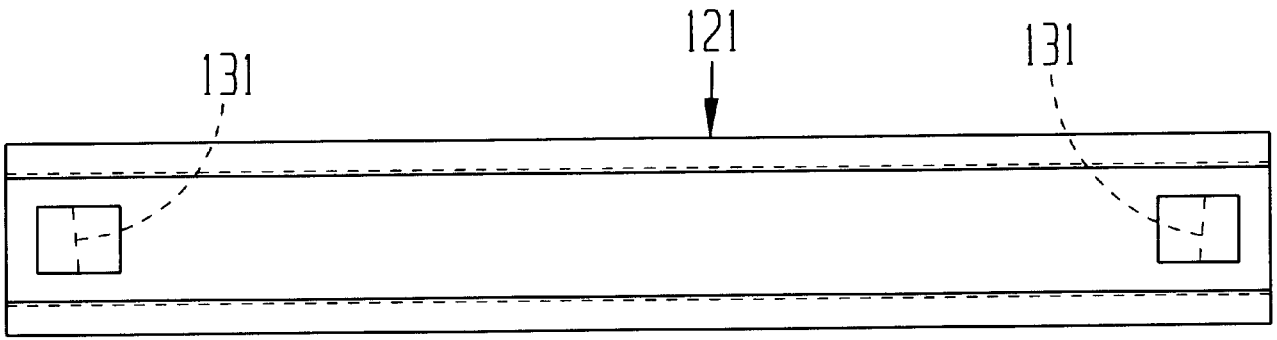
FIG. 13 is a front view of an alternate embodiment of the holder.
Figure 14:
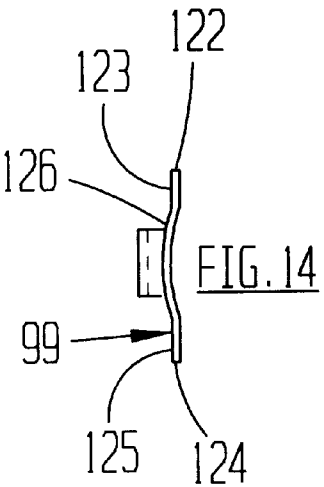
FIG. 14 is an end view of the holder of FIG. 13.

A still further holder 121 is shown in FIGS. 13–15. The holder 121 has top and bottom edges 122 and 124, respectively, and a middle region 99 that comprises an upper panel 123, a lower panel 125, and a curved middle section 126. The upper and lower panels 123 and 125, respectively, are illustrated as being substantially flat and coplanar. The holder 121 has two channels 128 with downwardly converging surfaces 131 that are substantially identical to those described previously.

Figure 17:
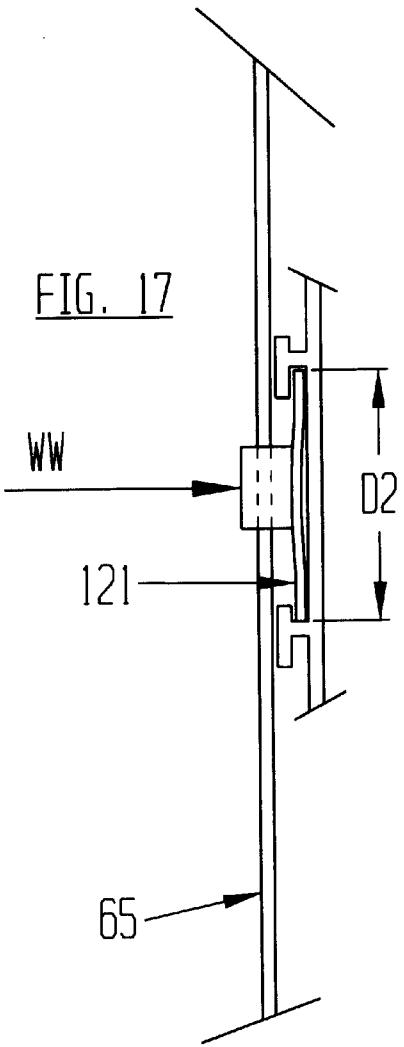
FIG. 17 is an end view similar to FIG. 16, but showing the deflection of the holder during removal of the decoration from the holder.
Figure 16:
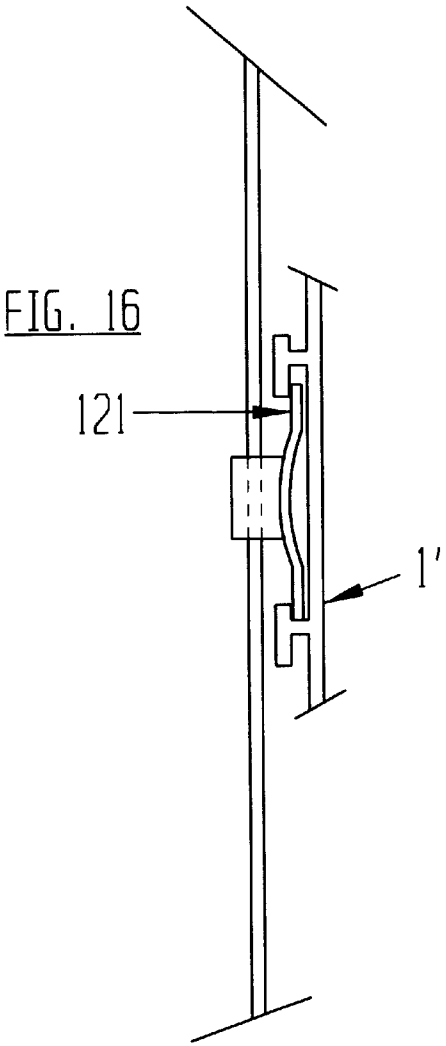
FIG. 16 is an end view of the holder of FIGS. 13–15 shown in normal use held between adjacent tracks of a conventional reader board.

FIG. 16 shows the holder 121 inserted in a conventional reader board 1' during normal use. FIG. 17 shows the deflection of the holder 121 during removal of a decoration 65. The curved middle section 126 becomes flattened during removal of a decoration. The upper and lower edges 122 and 124 spread apart to a distance D2, preventing removal of the holder.

Thus, it is apparent that there has been provided, in accordance with the invention, a sign decoration system that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A holder for removeably receiving a decoration and for being held in a reader board having an upper track and a lower track, and a back wall between the upper and lower tracks, the holder comprising:

a. a sheet of flexible material having an upper edge and a lower edge that define a plane and that are a first distance apart, and a middle region between the upper and lower edges that lies at least partially forwardly of the plane, the holder upper and lower edges being insertable into a reader board upper and lower tracks, respectively, to thereby hold the holder to the reader board, the holder upper and lower edges being spreadable apart to a second distance greater than the first distance in response to a force exerted on the middle region toward the reader board back wall; and b. means for removeably securing a selected decoration to the holder middle region, so that a force exerted on the decoration toward the reader board back wall is transferred to the holder middle region and causes the holder upper and lower edges to spread to the second distance therebetween and further into the reader board upper and lower tracks.

2. The holder of claim 1 wherein:

a. the holder middle region comprises a panel that is curved substantially continuously between the upper and lower edges; and b. the means for removeably securing a decoration comprises means for removeably securing the decoration to the curved panel, so that the force exerted on the decoration toward the reader board back wall causes the holder curved middle region to flatten and thereby causes the upper and lower edges to spread to the second distance therebetween.

3. The holder of claim 1 wherein the means for removably securing a decoration comprises a first channel and a second channel on said middle region, each of said channels comprising an abutting wall joined to the middle region and generally perpendicular thereto, and a retaining wall joined to the abutting wall and generally perpendicular thereto, said abutting walls having respective downwardly converging facing surfaces to thereby enable a decoration having similarly converging side edges to be received within the channels downwardly converging facing surfaces.

4. The holder of claim 1 wherein:

a. said middle region comprises;

i. a flat upper panel adjacent said upper edge, and a flat lower panel adjacent said lower edge; and ii. a panel that is curved substantially continuously between the upper and lower panels; and b. the means for removeably securing a decoration comprises means for removeably securing the decoration to the curved panel, so that the force exerted on the decoration toward the reader board back wall causes the holder curved middle region to flatten and thereby causes the upper and lower edges to spread to the second distance therebetween.

5. The holder of claim 1 wherein:

a. the holder middle region comprises a generally flat upper panel adjacent the upper edge, a generally flat lower panel adjacent the lower edge, and a middle panel joined to the upper and lower panels with a first leg and a second leg, respectively, said first leg having first junctions with said upper panel and said middle panel, said second leg having second junctions with said lower panel and said middle panel; and b. the means for removeably securing a selected decoration comprises means for removeably securing the selected decoration to the middle panel, so that the force exerted on the decoration toward the reader board back panel causes the holder legs to bend at their first and second junctions with the middle panel and with the upper and lower panels to thereby cause the upper and lower edges to spread to the second distance therebetween.

6. The holder of claim 5 wherein the means for removably securing a decoration comprises a first channel and a second channel each comprising an abutting wall joined to the middle panel and generally perpendicular thereto, and a retaining wall joined to the abutting wall and generally perpendicular thereto, said abutting walls having respective downwardly converging facing surfaces to thereby enable the decoration having similarly converging side edges to be received within the downwardly converging facing surfaces.

7. The holder of claim 5 wherein said upper panel and said lower panel lie in a common plane.

8. The holder of claim 5 wherein said upper panel and said lower panel lie in respective planes that are not coplanar.

9. The holder of claim 4 wherein said upper panel and said lower panel lie in a common plane.

10. The holder of claim 4 wherein said upper panel and said lower panel lie in respective planes that are not coplanar.

11. A method of removing a decoration from a holder having upper and lower edges at a first distance apart and inserted into associated tracks of a reader board comprising the steps of:

a. gripping a suction cup to the decoration;

b. applying force with the suction cup against the decoration;

c. transferring the force from the decoration to a middle region of the holder;

d. deflecting the holder middle region and causing the holder upper and lower edges to spread farther into the associated reader board tracks; and e. raising the suction cup to remove the decoration from the holder, whereby the steps of deflecting the holder middle region and causing the holder upper and lower edges to spread farther into the associated reader board tracks assure that the holder remains held in the reader board when removing the decoration from the holder.

12. Apparatus for displaying selected messages comprising:

a. a reader board having first and second tracks;

b. a decoration formed as a thin plate having opposed side edges that converge downwardly at a predetermined angle; and c. a holder comprising:

i. a sheet of flexible material having first and second edges spaced apart a first distance and defining a plane;

ii. a middle region between the first and second edges and lying forwardly of the plane, the middle region flexing in response to a force applied thereto in the direction on the plane to cause the first and second edges to spread apart to a second distance greater than the first distance; and iii. means for removeably securing the decoration side edges to the holder.

13. The apparatus of claim 12 wherein the means for removeably holding the decoration side edges comprises first and second spaced apart channels on the holder middle region, the channels being formed with respective facing surfaces that converge downwardly at the predetermined angle, so that the decoration side edges are securable in a wedging action between the holder channels converging surfaces.

14. The apparatus of claim 12 wherein:

a. the holder middle region comprises a first panel adjacent the first edge, a second panel adjacent the second edge, a third panel that is generally parallel to the plane, a first leg between and non-coplanar with the first panel and the third panel and having first junctions therewith, and a second leg between and non-coplanar with the second panel and the third panel and having second junctions therewith;

b. the means for removeably holding the decoration side edges comprises first and second spaced apart channels on the third panel, the channels being formed with respective facing surfaces that converge downwardly at the predetermined angle; and c. a force applied to the decoration in the direction on the plane is transferred to the holder channels and thence to the holder third panel and causes the first and second legs to flex about the first and second junctions thereof and thereby cause the holder first and second edges to spread apart in the associated reader board tracks to a second distance greater than the first distance.

15. The apparatus of claim 12 wherein the holder middle region comprises a continuously curved panel between the first and second edges.

16. The apparatus of claim 15 wherein the means for removeably holding the decoration side edges comprises first and second spaced apart channels on the holder curved panel, the channels being formed with respective facing surfaces that converge downwardly at the predetermined angle, so that the decoration side edges are securable in a wedging action between the holder channels converging surfaces.

17. The apparatus of claim 14 wherein the first and second panels are generally coplanar.

18. The apparatus of claim 14 wherein the first and second panels are non-coplanar.

19. The apparatus of claim 12 wherein:

a. the holder middle region comprises a first panel adjacent the first edge, a second panel adjacent the second edge, and a continuously curved panel between the first and second edges;

b. the means for removeably holding the decoration side edges comprises first and second spaced apart channels on the curved panel, the channels being formed with respective facing surfaces that converge downwardly at the predetermined angle; and c. a force applied to the decoration in the direction on the plane is transferred to the holder channels and thence to the holder curved panel and causes the curved panel to flex and thereby cause the holder first and second edges to spread apart in the associated reader board tracks to a second distance greater than the first distance.

20. The apparatus of claim 18 wherein the first and second panels are generally coplanar.

21. The apparatus of claim 18 wherein the first and second panels are non-coplanar.

* * * * *